US010461442B2

(12) United States Patent
Takasaki

(10) Patent No.: US 10,461,442 B2
(45) Date of Patent: Oct. 29, 2019

(54) PRESSURE CONTACT TERMINAL FOR CONNECTING ELECTRONIC COMPONENT AND WIRE

(71) Applicant: Yazaki Corporation, Tokyo (JP)

(72) Inventor: Tetsuro Takasaki, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 15/987,014

(22) Filed: May 23, 2018

(65) Prior Publication Data

US 2018/0351266 A1 Dec. 6, 2018

(30) Foreign Application Priority Data

Jun. 1, 2017 (JP) ..... 2017-109016

(51) Int. Cl.

| | |
|---|---|
| ***H01R 4/24*** | (2018.01) |
| ***H01R 4/2429*** | (2018.01) |
| ***H01R 33/09*** | (2006.01) |
| *H01R 12/71* | (2011.01) |

(52) U.S. Cl.

CPC ..... *H01R 4/2429* (2013.01); *H01R 33/09* (2013.01); *H01R 12/712* (2013.01)

(58) Field of Classification Search

CPC ..... H01R 4/2429
USPC ..... 439/404
See application file for complete search history.

(56) References Cited

U.S. PATENT DOCUMENTS

| | | | | | |
|---|---|---|---|---|---|
| 4,159,500 | A * | 6/1979 | Baumbach | H01R 9/2441 | 337/32 |
| 4,741,711 | A * | 5/1988 | Singer, Jr. | H04M 3/18 | 361/119 |
| 4,822,306 | A * | 4/1989 | Klaiber | H01R 9/2641 | 439/709 |
| 5,141,449 | A * | 8/1992 | Tieszen | F21V 21/002 | 439/419 |
| 5,330,368 | A * | 7/1994 | Tsuruzono | F21V 21/002 | 362/249.01 |
| 5,399,098 | A * | 3/1995 | Marshall | H01R 4/245 | 439/397 |
| 5,444,428 | A * | 8/1995 | Carr | H01H 85/201 | 337/188 |
| 5,846,098 | A * | 12/1998 | Shiga | H01R 4/2433 | 439/409 |
| 6,017,241 | A * | 1/2000 | Komai | H01R 4/2404 | 439/409 |

(Continued)

FOREIGN PATENT DOCUMENTS

| | | | |
|---|---|---|---|
| JP | 55158174 | U | 11/1980 |
| JP | 02117074 | A | 5/1990 |

(Continued)

*Primary Examiner* — Neil Abrams
(74) *Attorney, Agent, or Firm* — Sughrue Mion, PLLC

(57) ABSTRACT

A pressure contact terminal includes a component clip configured to clip an electronic component and be electrically connected with the electronic component, a pressure contact blade to be connected with a wire by pressure contact, and a step connection configured to connect the component clip and the pressure contact blade to each other at different bottom face heights. The step connection of the pressure contact terminal may prevent displacement of the pressure contact blade from being transmitted to the component clip.

6 Claims, 6 Drawing Sheets

(56) References Cited

U.S. PATENT DOCUMENTS

| | | | | |
|---|---|---|---|---|
| 6,218,622 | B1 * | 4/2001 | Rimmer | H02G 5/005 174/117 FF |
| 6,220,890 | B1 * | 4/2001 | Turek | H01R 4/242 439/404 |
| 6,247,961 | B1 * | 6/2001 | McCoy | H01R 4/4809 439/439 |
| 6,297,447 | B1 * | 10/2001 | Burnett | H01R 9/0524 174/40 CC |
| 7,156,689 | B2 * | 1/2007 | Fabian | H01R 4/2433 439/417 |
| 7,217,012 | B2 * | 5/2007 | Southard | G09F 9/33 362/240 |
| 7,270,551 | B2 * | 9/2007 | Busse | H01R 29/00 439/188 |
| 7,695,306 | B2 * | 4/2010 | Chiba | H01C 1/01 439/404 |
| 8,257,106 | B2 * | 9/2012 | Fornage | H01R 13/639 439/304 |
| 2008/0137377 | A1 * | 6/2008 | Brengartner | F21V 21/002 362/640 |
| 2018/0351266 | A1 * | 12/2018 | Takasaki | H01R 33/09 |

FOREIGN PATENT DOCUMENTS

| | | | |
|---|---|---|---|
| JP | 2009-190657 | A | 8/2009 |
| JP | 2013109994 | A | 6/2013 |

* cited by examiner

PRESSURE CONTACT TERMINAL FOR CONNECTING ELECTRONIC COMPONENT AND WIRE

CROSS REFERENCE TO RELATED APPLICATION

This application is based upon and claims the benefit of priority from the prior Japanese Patent Application No. 2017-109016, filed on Jun. 1, 2017, the entire contents of which are incorporated herein by reference.

BACKGROUND

1. Technical Field

The disclosure relates to a pressure contact terminal having a pressure contact blade to be connected with wire and also having a connection portion to be connected with an electronic component.

2. Related Art

JP 2009-190657 A proposes a pressure contact terminal. As illustrated in FIG. 1, a pressure contact terminal 100 has: component connections (a pressure contact blade) 101*a* and 101*b* to be electrically connected with electronic components 110 and 111; a pressure contact blade 102 to be connected with wire (unillustrated) by pressure contact; and connections 103 and 104 configured to connect the component connections 101*a*, 101*b* and the pressure contact blade 102 to each other.

The electronic components 110 and 111 are connected with the component connections 101*a* and 101*b*, and then wire is connected with the pressure contact blade 102 by pressure contact.

SUMMARY

Regarding the pressure contact terminal 100 provided with the connections 103 and 104 having flats forms, when the pressure contact blade 102 is moved (deformed) by load during wire pressure contact work, the movement (deformation) of the pressure contact blade 102 is easily transmitted to the component connections 101*a* and 101*b*. Movement (deformation) is easily transmitted especially to the side of the component connection 101*a*. Thus, fine sliding abrasion powder or the like generated by the movement (deformation) of the component connections 101*a* and 101*b* may possibly cause a contact failure.

The disclosure is directed to a pressure contact terminal with which a contact failure due to load during wire pressure contact work is not caused by a component connection.

A pressure contact terminal in accordance with some embodiments includes a component clip configured to clip an electronic component and be electrically connected with the electronic component, a pressure contact blade to be connected with a wire by pressure contact, and a step connection configured to connect the component clip and the pressure contact blade to each other at different bottom face heights.

With the above structure, when the pressure contact blade is moved (deformed) by load during wire pressure contact work, the movement (deformation) is absorbed by a step connection, and displacement of the pressure contact blade is not transmitted to a component clip. Accordingly, a contact failure due to load during wire pressure contact work is not caused by the component clip.

DETAILED DESCRIPTION

Figure 1:
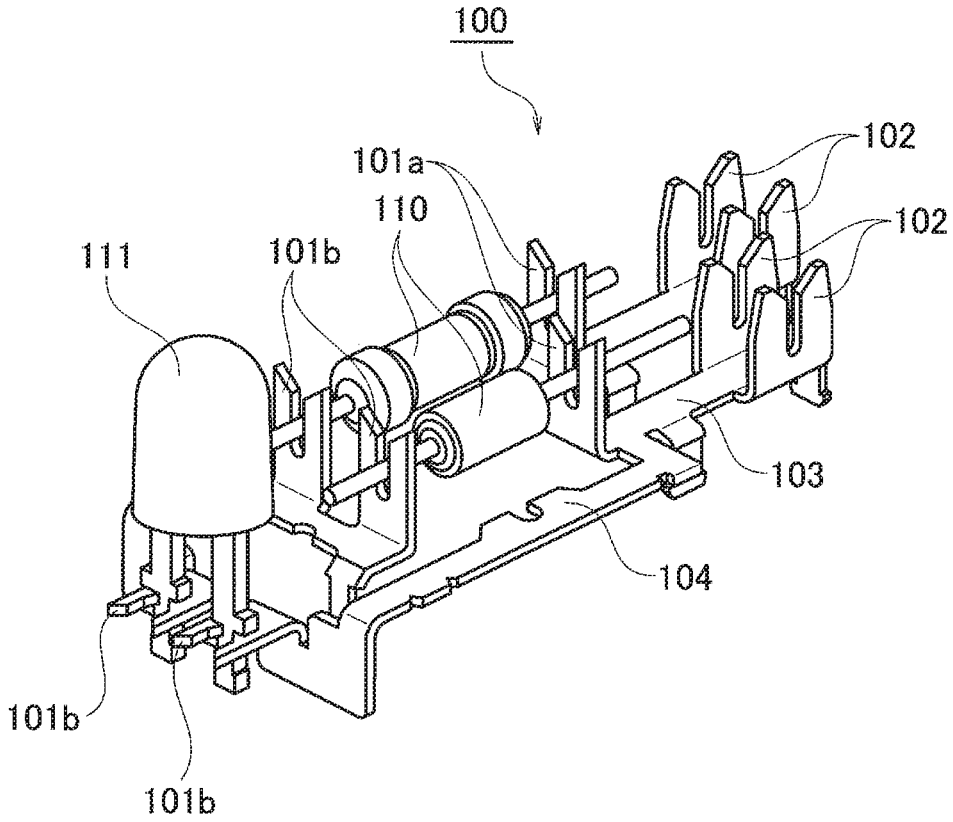
FIG. 1 PRIOR ART
FIG. 1 is a perspective view of a related pressure contact terminal.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

The following description will explain an embodiment of the present invention with reference to the drawings.

Figure 2:
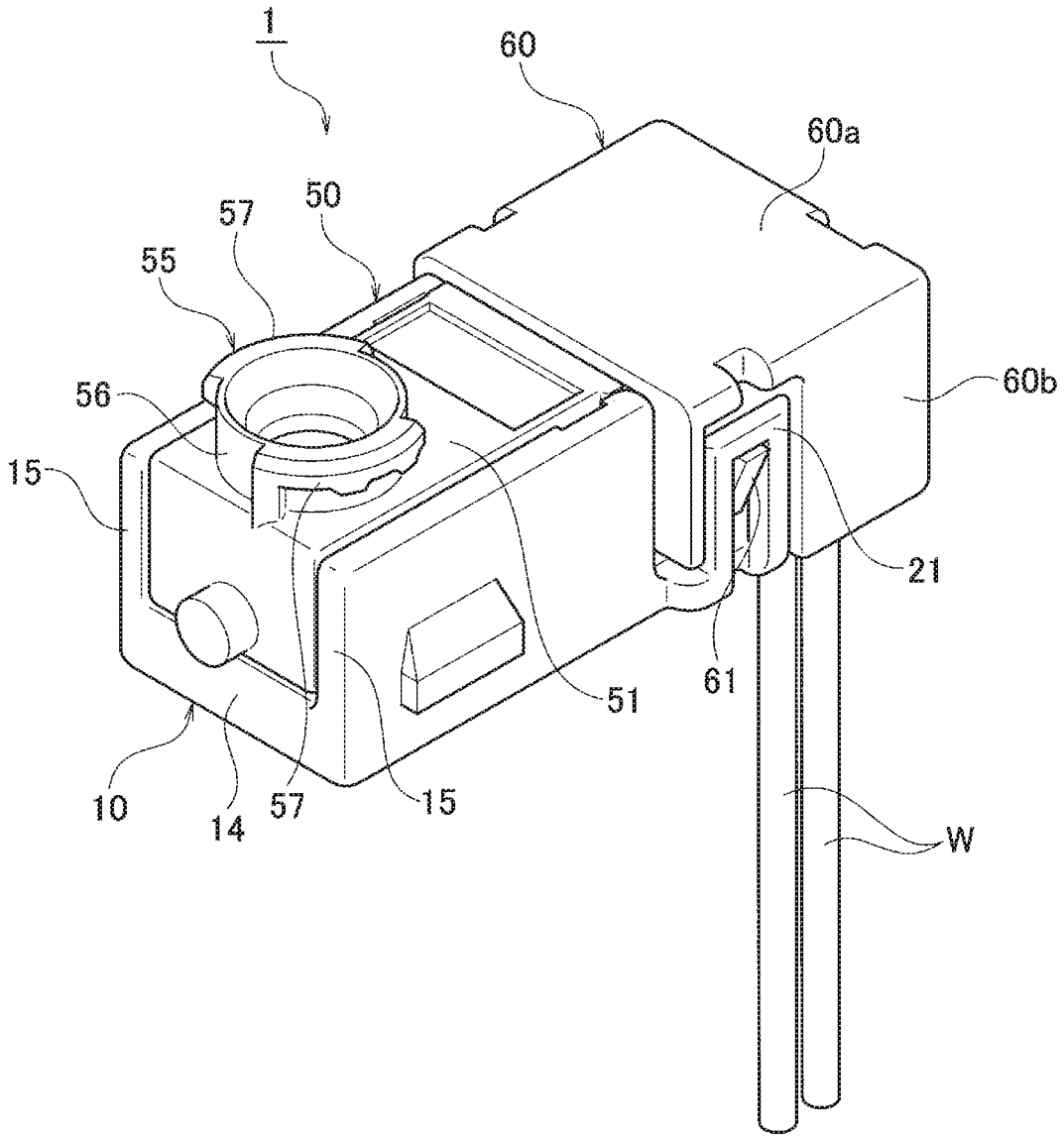
FIG. 2 illustrates an embodiment of the present invention, and is a perspective view of a lighting unit.
Figure 3:
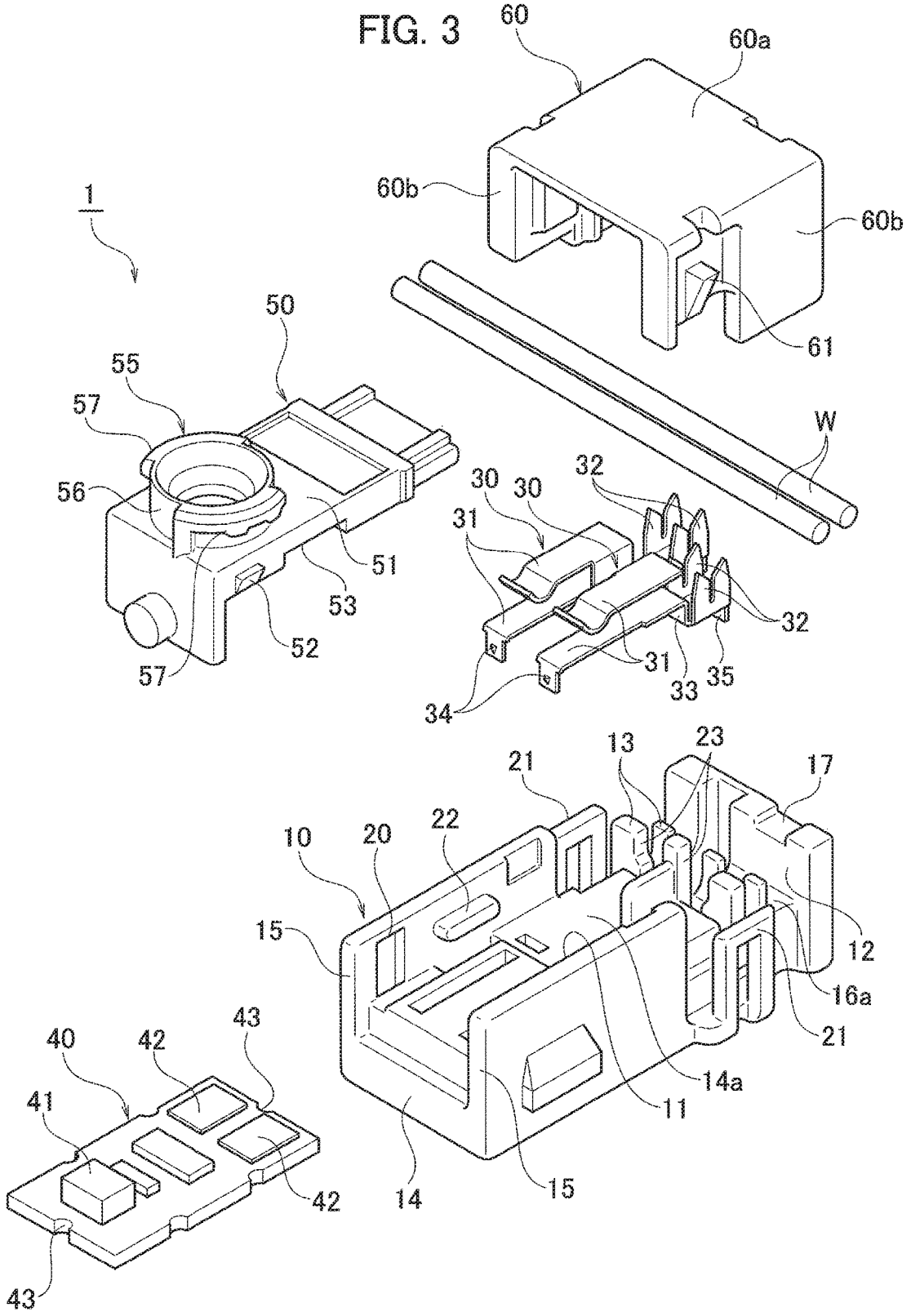
FIG. 3 illustrates an embodiment of the present invention, and is an exploded perspective view of a lighting unit.

FIGS. 2 to 5 illustrate an embodiment of the present invention. As illustrated in FIGS. 2 and 3, a lighting unit 1 is provided with: a housing 10, a pressure contact terminal 30 to be arranged in the housing 10; a substrate 40, which is an electronic component to be arranged in the housing 10; a cover 50 to be installed to the housing 10; and a wire cover 60 to be installed to the housing 10.

The housing 10 is formed of a member which does not transmit light. The housing 10 has a rough external form of a rectangular parallelepiped. The housing 10 has a component housing chamber 11 and a wire pressure contact chamber 12. A partition wall 13 is provided between the component housing chamber 11 and the wire pressure contact chamber 12. The component housing chamber 11 is surrounded by a bottom wall 14, side walls 15 which are a pair of vertically arranged walls, and the partition wall 13, and the top face and the front face of the component housing chamber 11 are opened. The opened areas are covered mainly by the cover 50. The substrate 40 is arranged in the component housing chamber 11.

The wire pressure contact chamber 12 is surrounded by a bottom wall 16, the partition wall 13, and a back wall 17, and the top face and both side faces of the wire pressure contact chamber 12 are opened. The opened areas are covered by the wire cover 60.

A pair of locking protrusions 20 is provided at inner faces of the pair of side walls 15. Each locking protrusion 20 is formed by notching the inner face side of a side wall 15. That is, a protruded face of each locking protrusion 20 has the same height as, that is, is flush with other inner face of the side wall 15.

A pair of positioning protrusions 22 is provided on inner faces of the pair of side walls 15. Each positioning protrusion 22 has a rectangular parallelepiped block shape.

A pair of lock arms 21 protruded outward from the respective side walls 15 is provided at areas where the pair of side walls 15 is missing.

A pair of terminal insertion grooves 23 is provided at the partition wall 13. Each terminal insertion groove 23 communicates between the component housing chamber 11 and the wire pressure contact chamber 12.

Figure 5:
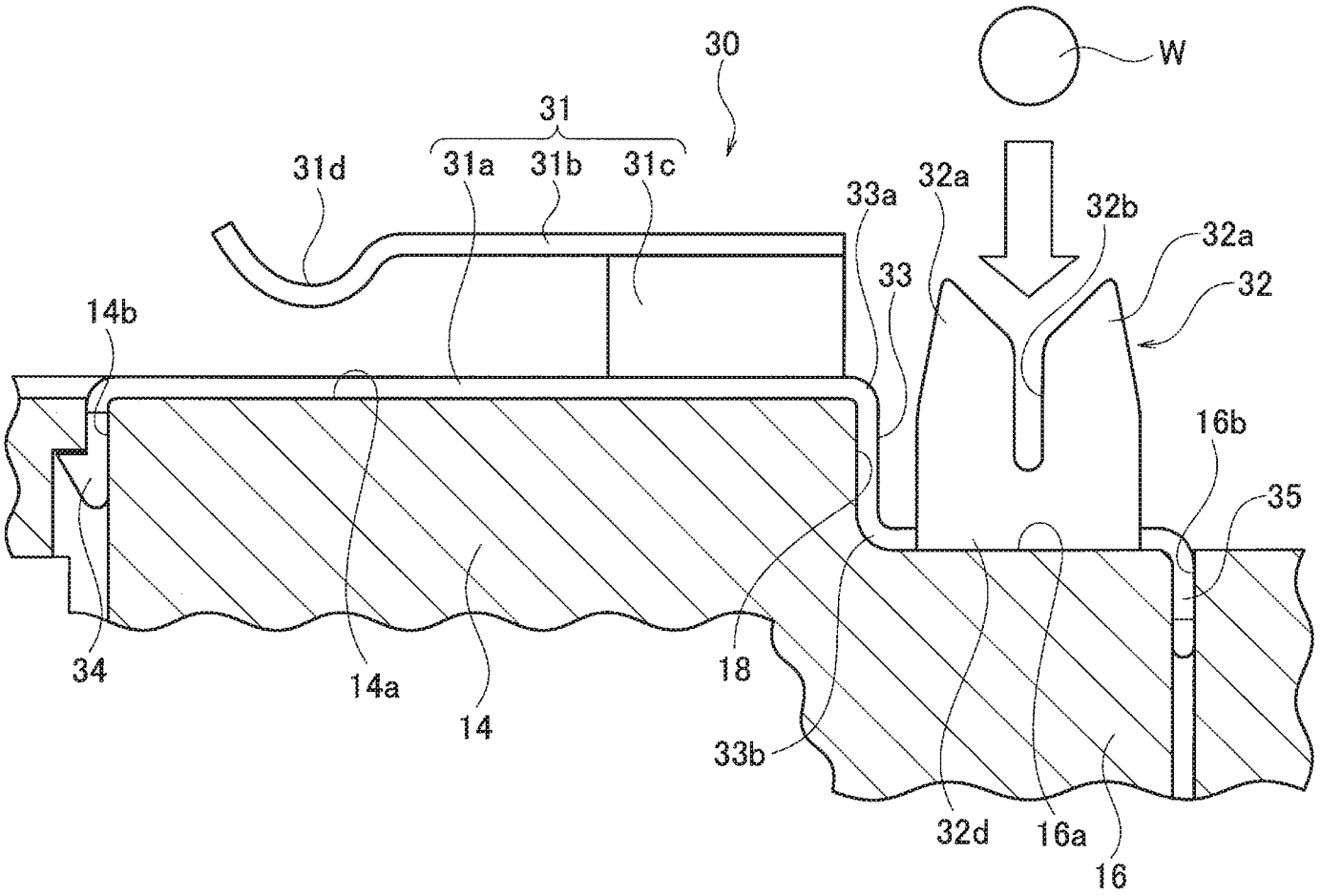
FIG. 5 illustrates an embodiment of the present invention, and is a sectional view illustrating a fixed state of a pressure contact terminal to a housing.

As illustrated in detail in FIG. 5, a bottom face 14*a*, which is a first arrangement face of the component housing chamber 11, and a bottom face 16*a*, which is a second arrangement face of the wire pressure contact chamber 12, have different heights. The bottom face 14*a* of the component housing chamber 11 is higher, and the bottom face 16*a* of the wire pressure contact chamber 12 is lower. A step face 18 is provided between the bottom face 14*a* and the bottom face 16*a*. Press-fit holes 14*b* and 16*b* are respectively provided at the bottom wall 14 and the bottom wall 16.

Pressure Contact Terminal

Figure 4:
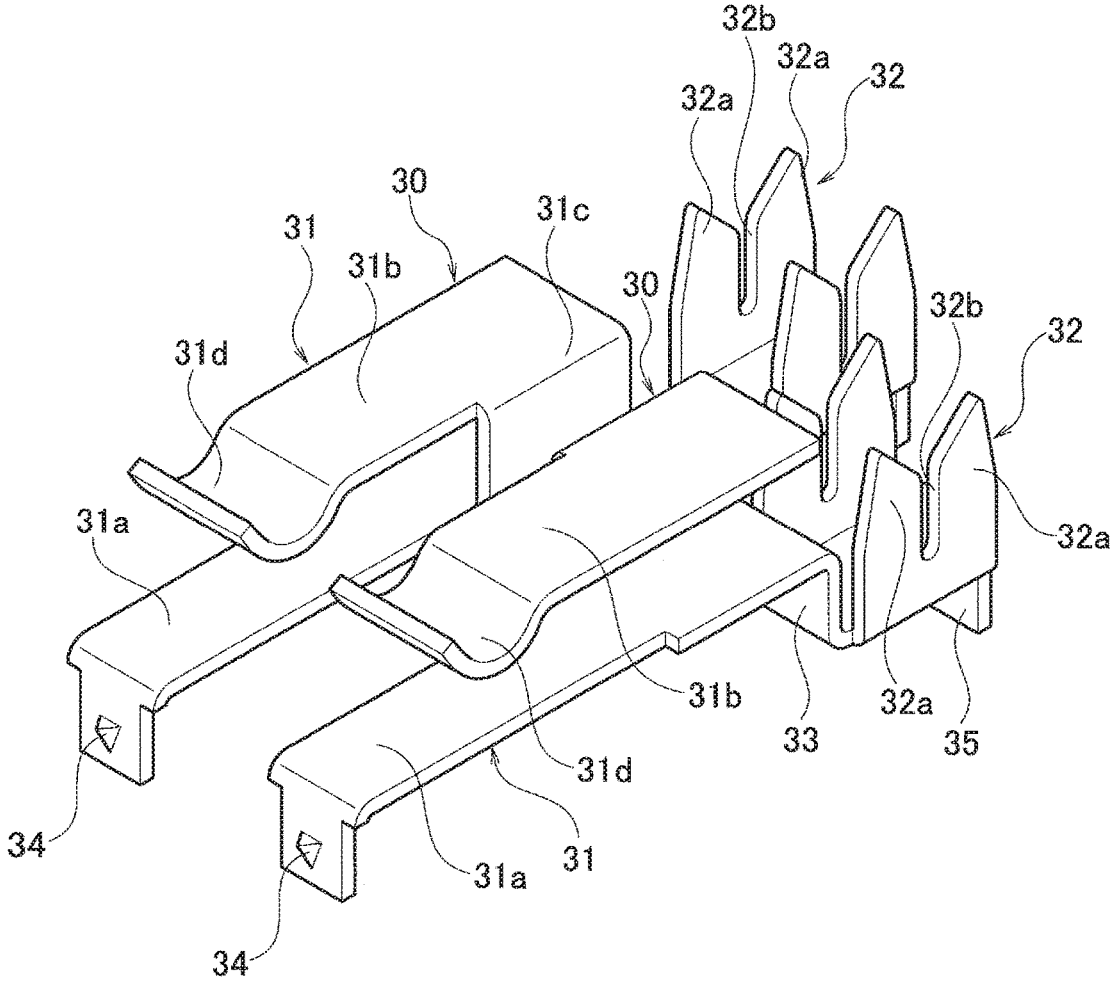
FIG. 4 illustrates an embodiment of the present invention, and is a perspective view of a pressure contact terminal.

As illustrated in detail in FIGS. 4 and 5, each pressure contact terminal (bus bar) 30 is formed by bending a conductive metal plate having a predetermined shape. Each pressure contact terminal 30 is provided with: a component clip 31 configured to clip the substrate 40 (hold the substrate 40 therebetween) and be electrically connected with the substrate 40; a pressure contact blade 32 to be connected with a wire W by pressure contact; and a step connection 33 configured to connect the component clip 31 and the pressure contact blade 32 to each other.

The component clip 31 is composed of: a fixed contact piece 31*a*; a spring contact piece 31*b*, which is arranged parallel to and at an interval from the fixed contact piece 31*a*; and a connection piece 31*c* configured to connect the fixed contact piece 31*a* and the spring contact piece 31*b* to each other. A circular arc 31*d* with an indent is provided at a tap of the spring contact piece 31*b*.

The pressure contact blade 32 has: a base 32*d* extended from the step connection 33; and two pairs of pressure contact blade pieces 32*a* vertically arranged from the base 32*d*. A slit 32*b* opened upward is formed between each pair of pressure contact blade pieces 32*a*.

Press-fit claws 34 and 35 hung downward are respectively provided at respective tip positions of the component clip 31 and the pressure contact blade 32. The step connection 33 is connected with the component clip 31 and with the pressure contact blade 32 respectively via perpendicularly bent portions 33*a* and 33*b*. The step connection 33 connects the component clip 31 and the pressure contact blade 32 to each other at different bottom face heights.

Each pressure contact terminal 30 is arranged across the wire pressure contact chamber 12 and the component housing chamber 11 by utilizing the terminal insertion groove 23. In particular, regarding each pressure contact terminal 30, the fixed contact piece 31*a* of each component clip 31 is arranged on the bottom face 14*a* of the component housing chamber 11, and the base 32*d* of each pressure contact blade 32 is arranged on the bottom face 16*a* of the wire pressure contact chamber 12. The step connection 33 is arranged in tight contact with the step face 18. The press-fit claw 34 of each component clip 31 is press-fitted into the press-fit hole 14*b*, and the press-fit claw 35 of each pressure contact blade 32 is press-fitted into the press-fit hole 16*b*.

Substrate

On the substrate 40 which is an electronic component, a light emitting diode 41 and other electronic components (no reference symbol is attached) are mounted, and a circuit pattern is also provided. These electronic components and circuit pattern compose a driving circuit for the light emitting diode 41. A pair of contacts 42 is formed as a part of the circuit pattern. The pair of contacts 42 is arranged on corresponding upper and lower faces of the substrate 40 (a contact on a rear face is not shown in the drawings). In a state where the substrate 40 is housed in the component housing chamber 11, a part between the pair of contacts 42 is clipped between the component clip 31 of the pressure contact terminal 30, and the pressure contact terminal 30 and the substrate 40 are electrically connected with each other by using deflection deformation returning force of the spring contact piece 31*b* as contact pressure.

The substrate 40 is a flat rectangular parallelepiped, and positioning grooves 43 are provided respectively at an insertion tip face to the component housing chamber 11 and at an insertion back end face. When the substrate 40 is at a position housed in the component housing chamber 11, a substrate positioning protrusion (unillustrated) of the partition wall 13 enters into the positioning groove 43 of the insertion tip face of the substrate 40, and a substrate positioning protrusion (unillustrated) of the cover 50 enters into the positioning groove 43 of the insertion back end face of the substrate 40, so that the substrate 40 is positioned with respect the insertion direction/separation direction.

Cover

The cover 50 is formed of a member which does not transmit light. The cover 50 has an L-shaped closing plate 51, which enters into the top face opening and the front face opening of the component housing chamber 11 of the housing 10 without gap. The cover 50 closes the top face and the front face of the component housing chamber 11 in a state where the cover 50 is installed to the housing 10. The top face and the front face of the closing plate 51 each have the same height as, that is, are flush with the top face and the front face of the housing 10.

A pair of lock claws 52 is provided on both side faces of the closing plate 51. Each lock claw 52 is protruded outward from a side face of the closing plate 51. A pair of positioning recesses 53 is provided at both side parts on the lower face side of the closing plate 51. In a state where the cover 50 is installed to the housing 10, the pair of lock claws 52 are locked to the locking protrusions 20 of the housing 10, and the pair of positioning recesses 53 are locked to the positioning protrusions 22 of the housing 10. The cover 50 is positioned in the height direction and the anteroposterior direction (longitudinal direction) by the positioning recesses 53 and the positioning protrusions 22.

A cover side attachment 55 is protruded from a top face of the closing plate 51. The cover side attachment 55 has a cylinder 56, and a locking part 57 protruded from the outer circumference of the cylinder 56. The cylinder 56 is positioned right above the light emitting diode 41. Light from the light emitting diode 41 travels through the inside of the cylinder 56 and is emitted to the outside.

The cover 50 is attached to an attachment hole (unillustrated) of a bracket (unillustrated) of a vehicle body panel, for example, through rotating operation using the cover side attachment 55.

Wire Cover

The wire cover 60 is formed of a member which does not transmit light. The wire cover 60 has a top face wall 60*a*, and a pair of side face walls 60*b* hung from both side ends of the top face wall 60*a*. In a state where the wire cover 60 is installed to the housing 10, the wire cover 60 closes a part of the component housing chamber 11 of the housing 10 and an opening of the wire pressure contact chamber 12. The top face of the top face wall 60*a* of the wire cover 60 has the same height as, that is, is flush with the top face of the housing 10.

A pair of lock claws 61 is provided at both side face walls 60*b* of the wire cover 60. Each lock claw 61 is formed by notching the outer face side of a side face wall 60*b*. That is, the tip of each lock claw 61 has the same height as, that is, is flush with the outer face of the side face wall 60*b*. This makes the top face of the wire cover 60 flush with the top face of the cover 50 and makes side faces of the wire cover 60 flush with outer faces of the lock arms 21 of the housing 10 in a state where the wire cover 60 is installed to the housing 10.

Assembly Procedures of Lighting Unit

Next, assembly procedures of the lighting unit 1 will be described.

A portion of the step connection 33 of each pressure contact terminal 30 is matched to each terminal insertion groove 23, and each pressure contact terminal 30 is inserted into the housing 10 from an upper side. In addition, the respective press-fit claws 34 and 35 of the component clip 31 and the pressure contact blade 32 are respectively press-fitted into the press-fit holes 14*b* and 16*b*. Thus, a component clip 31 of each pressure contact terminal 30 is arranged in the component housing chamber 11, and a pressure contact blade 32 of each pressure contact terminal 30 is arranged in the wire pressure contact chamber 12. In particular, the component clips 31 are arranged on the bottom face 14*a* of the component housing chamber 11, and the pressure contact blades 32 are arranged on the bottom face 16*a* of the wire pressure contact chamber 12. Moreover, the step connection 33 is arranged along the step face 18 (see FIG. 5).

Next, the substrate 40 is inserted into the component housing chamber 11 from a front face opening of the housing 10. When the substrate 40 is at an insertion completion position, the pair of contacts 42 of the substrate 40 is clipped by the component clip 31 of the pressure contact terminal 30, and the pressure contact terminal 30 and the substrate 40 are electrically connected with each other.

Next, the cover 50 is assembled with the housing 10 from an upper side of the component housing chamber 11. Thus, the pair of lock claws 52 of the cover 50 is locked to the pair of locking protrusions 20 of the housing 10. Moreover, the pair of positioning protrusions 22 of the housing 10 is engaged with the pair of positioning recesses 53 of the cover 50. The cover 50 is assembled with the housing 10 with high accuracy without looseness by the positioning recesses 53 and the positioning protrusions 22.

Next, the wire W is pressed into the slit 32*b* of the pressure contact blade 32 from an upper side of the pressure contact terminal 30 and is connected with the pressure contact terminal 30 by pressure contact.

Next, the wire cover 60 is assembled with the housing 10 from an upper side of the wire pressure contact chamber 12. Thus, the lock claws 61 of the wire cover 60 are locked to the lock arms 21 of the housing 10. With the above procedures, assembly of the lighting unit 1 is completed.

Figure 6:
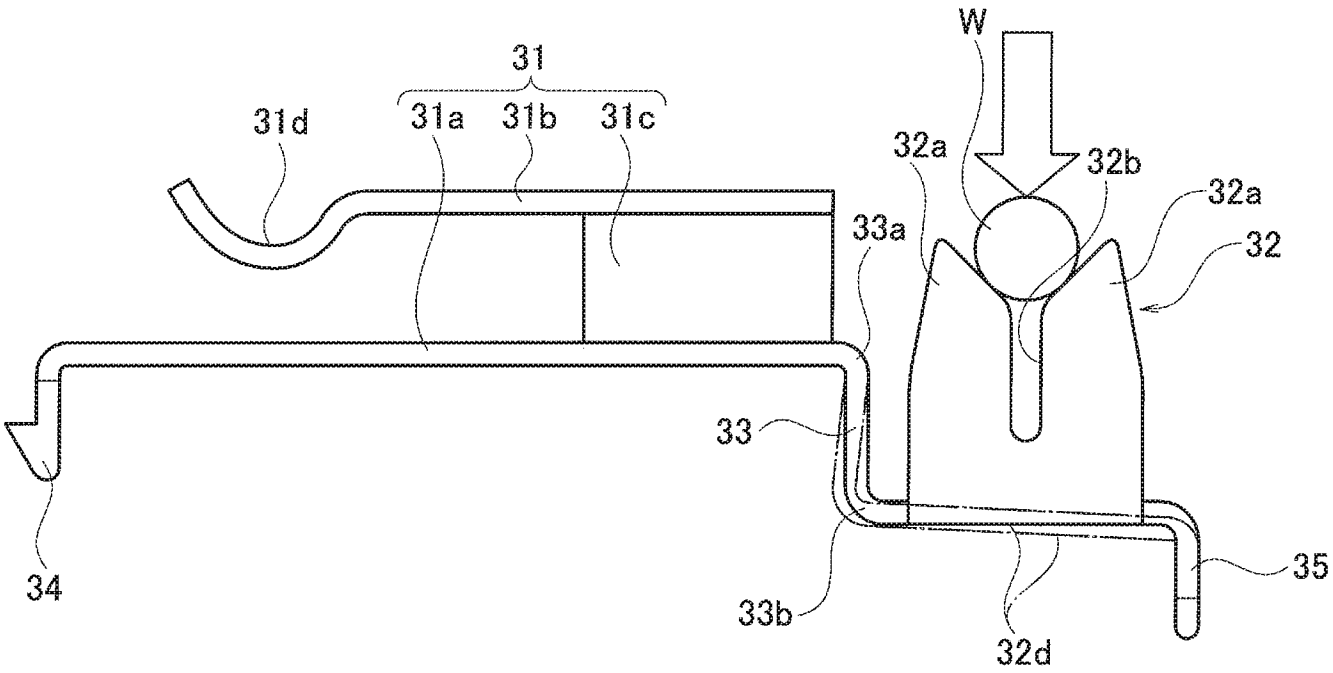
FIG. 6 illustrates an embodiment of the present invention, and is a view for explaining deformation absorption by a step connection.

When the wire W is pressed into the pressure contact blade 32 as illustrated in FIG. 5 in pressure contact work of the wire W to the pressure contact blade 32 in an assembly step of the lighting unit 1, load generated in such pressing acts on the pressure contact blade 32. Thus, the pressure contact blade 32 is moved (deformed) as illustrated with virtual lines in FIG. 6, for example. This movement (deformation) of the pressure contact blade 32 is absorbed as bending angles of the bent portions 33*b* and 33*a* of the step connection 33 are changed or the like. Accordingly, the movement (deformation) of the pressure contact blade 32 is not transmitted to the component clip 31.

Attachment Procedures of Lighting Unit to Attachment Hole

The locking part 57 is locked to an attachment hole (unillustrated) of a bracket (unillustrated) of a vehicle body panel, for example, when the cylinder 56 of the cover side attachment 55 is inserted into the attachment hole and the cover side attachment 55 is rotated. With the above procedures, attachment of the lighting unit 1 to a vehicle body is completed.

As described above, the pressure contact terminal 30 is provided with: the component clip 31 configured to clip the substrate 40 and be electrically connected with the substrate 40, which is an electronic component; the pressure contact blade 32 to be connected with the wire W by pressure contact; and the step connection 33 configured to connect the component clip 31 and the pressure contact blade 32 to each other at different bottom face heights.

Accordingly, when the pressure contact blade 32 is moved (deformed) by load during wire pressure contact work, the movement (deformation) is absorbed by the step connection 33, and the movement (deformation) of the pressure contact blade 32 is not transmitted to the component clip 31. Accordingly, a contact failure due to fine sliding abrasion powder or the like is not caused by the component clip 31.

The component clip 31 and the pressure contact blade 32 respectively have press-fit claws 34 and 35 to be press-fitted into the housing 10. Accordingly, the component clip 31 and the pressure contact blade 32 are reliably positioned with respect to the housing 10, and it is therefore possible to prevent not only deformation due to load during wire pressure contact work but also other deformation (floating) of the component clip 31 and the pressure contact blade 32.

The component clip 31 is arranged on the bottom face 14*a*, which is the first arrangement face of the housing 10, and the pressure contact blade 32 is arranged on the bottom face 16*a*, which is the second arrangement face having a height different from the first arrangement face of the housing 10. Accordingly, the component clip 31 is in tight contact with the bottom face 14*a* and the pressure contact blade 32 is in tight contact with the bottom face 16*a*, and it is therefore possible to prevent deformation of the pressure contact blade 32 itself due to load during wire pressure contact work as much as possible, and it is further possible to reliably prevent deformation of the component clip 31.

Although the electronic component is the substrate 40 in this embodiment, any electronic component can be employed as long as the electronic component can be electrically connected by clipping with the component clip 31.

Although the pressure contact terminal 30 is applied to the lighting unit 1 in this embodiment, it is clear that the pressure contact terminal 30 can be similarly applied to a device other than the lighting unit 1.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A pressure contact terminal comprising:

a component clip configured to clip an electronic component and be electrically connected with the electronic component;

a pressure contact blade to be connected with a wire by pressure contact;

a step connection configured to connect the component clip and the pressure contact blade to each other at different bottom face heights;

a first bent portion connecting the step connection and the component clip to each other at a first bending angle; and a second bent portion connecting the step connection and the pressure contact blade to each other at a second bending angle.

2. The pressure contact terminal according to claim 1, wherein the component clip is arranged on a first arrangement face of a housing, and the pressure contact blade is arranged on a second arrangement face of the housing having a height different from a height of the first arrangement face.

3. The pressure contact terminal according to claim 1, wherein the electronic component is a substrate.

4. A pressure contact terminal comprising:

a component clip configured to clip an electronic component and be electrically connected with the electronic component;

a pressure contact blade to be connected with a wire by pressure contact; and a step connection configured to connect the component clip and the pressure contact blade to each other at different bottom face heights, wherein the component clip has a first press-fit claw to be press-fitted into a housing, and the pressure contact blade has a second press-fit claw to be press-fitted into the housing.

5. The pressure contact terminal according to claim 4, wherein the component clip is arranged on a first arrangement face of the housing, and the pressure contact blade is arranged on a second arrangement face of the housing having a height different from a height of the first arrangement face.

6. The pressure contact terminal according to claim 4, wherein the electronic component is a substrate.

* * * * *